United States Patent [19]

Showalter

[11] 4,412,749

[45] Nov. 1, 1983

[54] PROGRAMMABLE ELECTRONIC TIME AND TIDE CLOCK

[75] Inventor: Thomas A. Showalter, Middletown, Pa.

[73] Assignee: Spectrum Design Co., Oberlin, Pa.

[21] Appl. No.: 374,404

[22] Filed: May 3, 1982

[51] Int. Cl.[3] ..... G04B 19/26

[52] U.S. Cl. ..... 368/19

[58] Field of Search ..... 368/19

[56] References Cited

U.S. PATENT DOCUMENTS 3,921,383 11/1975 Leone ..... 368/19

*Primary Examiner*—Bernard Roskoski

*Attorney, Agent, or Firm*—Adrian J. La Rue

[57] ABSTRACT

According to the present invention, a programmable electronic timing device includes two sets of counter circuits that count minutes, hours, and twelve hour intervals. Both sets of counter circuits feed time data into a time or tide data selector circuit under control of an oscillator circuit to alternately operate a display driver circuit that drives a display means to display real time and then when the next high or low tide is to occur. One of the sets of counter circuits advances the time to the next time that high or low tide is to occur, and, when the high or low tide has been reached, the next high or low tide will be displayed alternately along with the real time.

According to another aspect of the present invention, colored lights indicate whether the tide that is being indicated to occur will be high or low tide.

According to a further aspect of the present invention, additional time will be added when the eighth tide indication takes place to compensate for the fractional times that the previously high or low tides were indicated to have occured.

10 Claims, 3 Drawing Figures

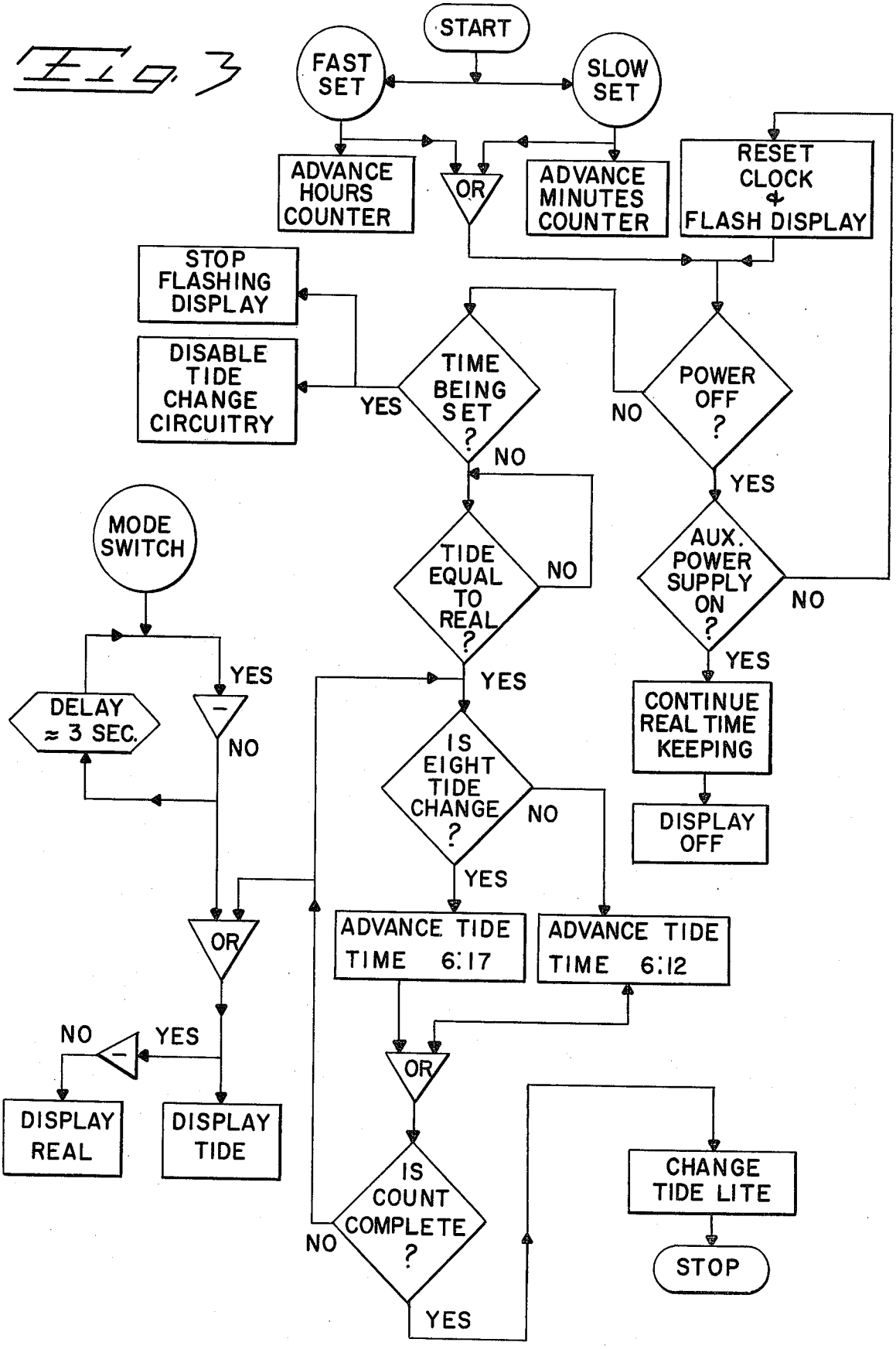
Fig. 3
START
FAST SET
SLOW SET
ADVANCE HOURS COUNTER
OR
ADVANCE MINUTES COUNTER
RESET CLOCK & FLASH DISPLAY
STOP FLASHING DISPLAY
DISABLE TIDE CHANGE CIRCUITRY
YES
TIME BEING SET ?
NO
POWER OFF ?
NO
YES
MODE SWITCH
TIDE EQUAL TO REAL ?
NO
AUX. POWER SUPPLY ON ?
NO
YES
YES
DELAY ≈ 3 SEC.
YES
NO
IS EIGHT TIDE CHANGE ?
NO
CONTINUE REAL TIME KEEPING
DISPLAY OFF
YES
OR
ADVANCE TIDE TIME 6:17
ADVANCE TIDE TIME 6:12
NO
YES
OR
DISPLAY REAL
DISPLAY TIDE
IS COUNT COMPLETE ?
NO
YES
CHANGE TIDE LITE
STOP

PROGRAMMABLE ELECTRONIC TIME AND TIDE CLOCK

FIELD OF THE INVENTION

This invention relates to an electronic timing device and more particularly to a programmable electronic timing device that alternately indicates real time and when high or low tide is to occur.

BACKGROUND OF THE INVENTION

Clocks are known for indicating real time and whether the next tide that is to occur will be high tide or low tide. A typical clock is one wherein the hands of the clock indicates real time, the clock face has high tide and low tide indicated thereon between 12 and 6 and between 6 and 12 while a third hand operated by the clock movement indicates whether the tide is operating at high tide or low tide but no indication is presented to indicate the time when high tide or low tide is to take place.

U.S. Pat. No. 3,982,104 discloses a time and tide calculating device for wrist watches and clocks that indicates the tides and the time of the tides which utilizes concentric tide and calendar disc means placed adjacent to a clock or watch face for indicative registration and cooperation with time telling devices whereby various arrangements of the tide and calendar disc show tide positions and the calendar data in registration with clock and watch faces that also includes information an time, data and whether the time is AM or PM. This arrangement is associated with the operation of the clock works or clock drive motor.

SUMMARY OF THE INVENTION

According to the present invention, a programmable electronic timing device includes two sets of counter circuits that count minutes, hours, and twelve hour intervals. Both sets of counter circuits feed time data into a time or tide data selector circuit under control of an oscillator circuit to alternately operate a display driver circuit that drives a dislay means to display real time and then when the next high or low tide is to occur. One of the sets of counter circuits advances the time to the next time that high or low tide is to occur, and, when the high or low tide has been reached, the next high or low tide will be displayed alternately along with the real time.

According to another aspect of the present invention, colored lights indicate whether the tide that is being indicated to occur will be high or low tide.

According to a further aspect of the present invention, additional time will be added when the eighth tide indication takes place to compensate for the fractional times that the previously high or low tides were indicated to have occured.

BRIEF DESCRIPTION OF THE DRAWINGS

FIG. 3 is a flow diagram for programming the programmable electronic time and tide timing device.

DETAILED DESCRIPTION OF A PREFERRED EMBODIMENT

The time between peak low tide and peak high tide is an average of 6 hours 12.625 minutes. The time and tide timing device of the present invention utilizes a conventional programmable timing integrated circuit that is available from National Semiconductor and other conventional integrated circuits that form the electronic circuits as shown in FIG. 2 to alternately display real time and the time when the next high or low tide is to occur.

Figure 1:
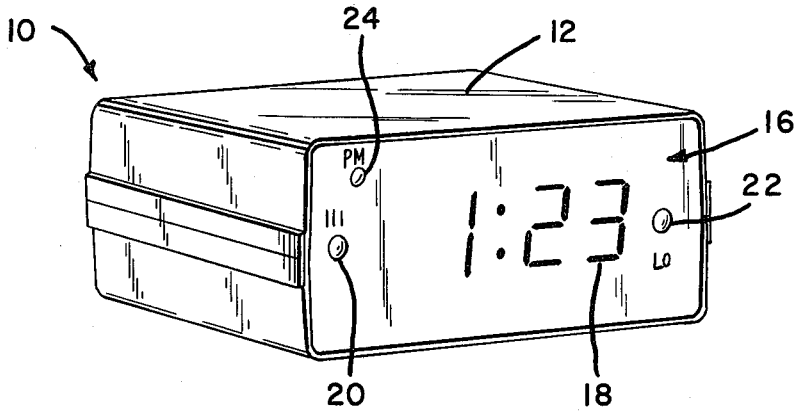
FIG. 1 is a perspective view of a programmable electronic time and tide timing device.
Figure 2:
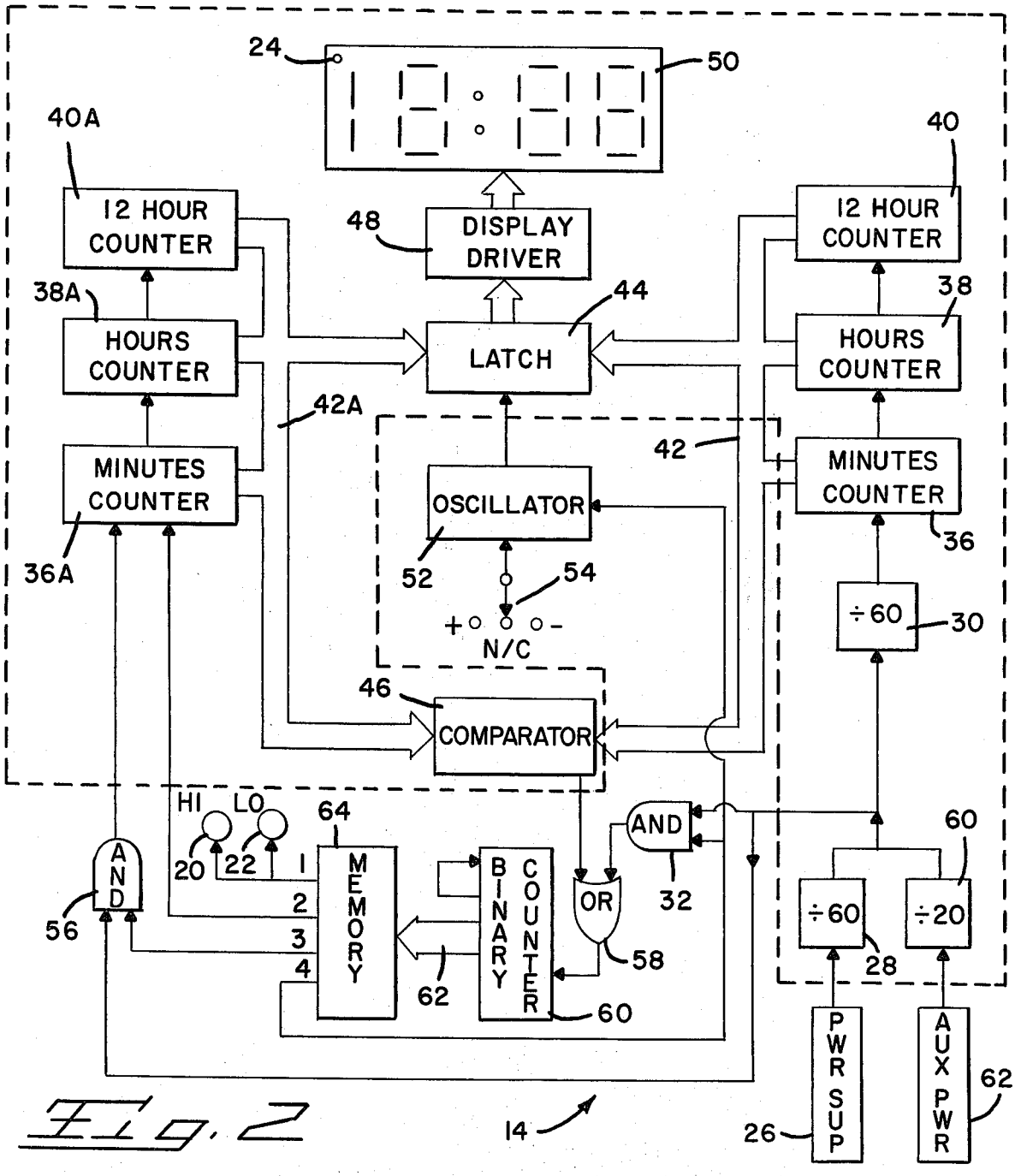
FIG. 2 is a block diagram of the electronic circuit of the programmable electronic time and tide timing device.

As shown in FIG. 1, a time and tide timing device 10 includes a housing 12 in which electronic circuit 14 of FIG. 2 is housed. A front panel 16 is mounted on housing 12. Panel 16 has a display area 18 for digitally displaying time and tide information, a green light indicating light 20 for indicating approaching high tide, a red indicating light 22 for indicating approaching low tide and a smaller indicating red light 24 for indicating PM time.

The time and tide timing device 10 is pluggable into normal 110 V 60 cycle AC circuits to operate it, and, as shown in FIG. 2, power supply 26 operates circuit 14 as stepped down voltage. The 60 cycle output from power supply 26 is fed into a divider circuit 28 which supplys an output signal therefrom of one pulse per second to another divider circuit 30 and to AND gate 32.

The output signal from divider circuit 30 is one pulse per minute which operates minute counter circuit 36. The output signal after sixty counts by counter circuit 36 operates hours counter circuit 38 and the output signal after twelve counts by counter circuit 38 operates twelve hour counter circuit 40. Counter circuits 36, 38 and 40 also provide output signals to Bus 42 which supplys such output signals to latch circuit 44 and to comparator circuit 46. Latch circuit 44 operates as a selector circuit about every four seconds to operate display driver circuit 48 to operate LED display member 50 to alternately display real time or the time when the next high or low tide is to occur in digital form. In this way approaching high tide or low tide can readily be calculated from the indicated real time.

An oscillator circuit 52 is connected to latch circuit 44 to operate latch circuit 44 about every four seconds. Mode switch 54 is connected to oscillator 52, and, in the N/C position, oscillator 52 will operate latch circuit 44 alternately to display real time and tide time every four seconds except when the time of high tide or low tide is reached, then display member 50 is dimmed and displays no discernable information for about eighteen seconds during which the next high or low tide to be displayed is being computed.

If switch 54 is moved to the negative position, tide time will be displayed only, and, when switch 54 is at the positive position, real time only will be displayed. However, neither tide time nor real time will be displayed during computation of next high or low tide.

Similar minute counter circuit 36A, hours counter circuit 38A and twelve hour counter circuit 40A as those of counter circuit 36, 38 and 40 and which operate in the same manner receive their operational signals from the output of AND gate 56 at one pulse per second which causes minute counter circuit 36A to operate at one minute per second thereby advancing the time by six hours and twelve minutes. This will take about eighteen seconds to accomplish.

The output from comparator circuit 46 is transmitted to OR gate 58 which also has inputs thereto from AND gates 32 and 56. The output from OR gate 58 is transmitted to binary counter circuit 60 and the output therefrom on bus 62 is in the form of address signals that are transmitted to memory circuit 64. Output signals are transmitted from memory circuit 64 as four outputs with the first output signals operating indicating lights 20, 22, the second output signals transmitting tide change signals to AND gate 56, the third output signals being transmitted to minute counter 36A as fast set signals and the fourth output signals being transmitted to AND gate 32 and comparator circuit 46 to advance binary counter circuit 60 and controls the operation of oscillator 52.

Memory circuit 64 is programmed with the necessary data required to control the tide change operation. Each of the four independent outputs has a specific function and each output receives its command of operation by the binary address signals from binary counter circuit 60. The specific address signals from binary counter circuit 60 to memory circuit 64 causes the program in memory circuit 64 to determine the enablement of the outputs of memory circuit 64.

After initial setting of real time and tide time, binary counter circuit 60 waits for a pulse from comparator circuit 46, memory circuit 64 being in standby. When coincidence occurs between real time and tide time, comparator circuit 46 transmits signals via OR gate 58 to binary counter 60 which is advanced by one count; this causes the memory address to be advanced and address signals are transmitted to memory circuit 64 to operate same. Signals from the fourth output of memory circuit 64 causes AND gate 32 to send the one pulse per second from divider circuit 28 to OR gate 58 which causes binary counter circuit 60 to transmit changing address signals to memory circuit 64. The program in memory circuit 64 then causes tide changing signals to be transmitted from the third output to minute counter 36A which is operated to advance at a rate of 60 minutes per second. After minute counter 36A has been advanced for six seconds, the third output from memory circuit 64 is disabled and the second output enables AND gate 56 which causes minute counter circuit 36A to advance at a rate of one minute per second. The second output will be disabled after twelve counts and so will the fourth output. Thus, signals are no longer arriving at binary counter circuit 60, and, at the same time the first output changes polarity thereby causing indicating lights 20, 22 to change operation.

At this time, memory circuit 64 is in standby and binary counter circuit 60 is waiting to receive control signals from comparator circuit 46 when real time and tide time are in coincidence once again.

As has been pointed out above, the peak high and low tide times occur at an average of every six hours and 12.625 minutes. In order to more accurately indicate correct high and low tide times, every eighth time that high and low tides occur, memory circuit 64 will cause the second output to be enabled for seventeen counts instead of twelve counts. In this way, the indicated high and low tides will be substantially accurate when they are indicated on display member 50.

FIG. 3 illustrates a flow diagram for programming the programmable electronic time and tide timing device including a subroutine to provide operation of the clock device if power failure occurs. If power failure does occur, then auxiliary power supply circuit 62 commences operation to supply 20 cycle signals to divider circuit 66 at the same voltage. Auxiliary power supply circuit 62 includes a battery which is connected to an oscillator circuit as part of display member 50 to provide the 20 cycle signal to divider circuit 66.

As pointed out above, all of the circuit elements within the dotted lines except oscillator circuit 52 are incorporated in the National Semiconductor integrated circuit. Oscillator circuit 52 and the remaining circuits outside the dotted lines are conventional circuits.

I claim:

1. A programmable electronic time and tide timing device, comprising:

pulse generating means for generating timing pulses;

first counter means for receiving said timing pulses and generating real time signals;

latch means and comparator means for receiving said real time signals;

oscillator means connected to said latch means for operating said latch means for a specified time;

memory circuit means and gate means receiving said timing pulses;

said memory circuit means adapted to generate tide time signals which are transmitted to said gate means;

second counter means receiving said tide time signals from said gate means and generating tide change signals which are transmitted to said latch means and said comparator means;

said comparator means triggering operation of said memory circuit means when said real time signals and said tide change signals are in coincidence thereby causing said memory circuit means to generate said tide change signals;

and display means connected to latch means for displaying alternately real time and the time when the next high or low tide is to occur.

2. A programmable electronic time and tide timing device as set forth in claim 1 wherein binary circuit means is connected between said comparator means and said memory circuit means for controlling operation of said memory circuit means when said real time signals are in coincidence with said tide change signals.

3. A programmable electronic time and tide timing device as set forth in claim 1 wherein driver circuit means is connected between said latch means and said display means.

4. A programmable electronic time and tide timing device as set forth in claim 1 wherein said gate means comprises an AND gate.

5. A programmable electronic time and tide timing device as set forth in claim 1 wherein indicating circuit means are connected to said memory circuit means for indicating high or low tide at the same time that the time when the next high or low tide is to occur.

6. A programmable electronic time and tide timing device as set forth in claim 1 wherein indicating means as part of said display means indicates PM time.

7. A programmable electronic time and tide timing device as set forth in claim 2 wherein said memory circuit means adds additional tide time signals to said tide time signals being generated by said counter circuit means at a selected time.

8. A programmable electronic time and tide timing device comprising:

means for generating timing signals;

means for receiving said timing signals and for generating real time signals;

first and second means for receiving said real time signals;

means for generating tide time signals and for transmitting said tide time signals to said first and second means;

means connected to said first means to alternately display for a specified time real time and when high or low tide is to take place;

means connected to said first means controlling the operation thereof to alternately display real time and when high or low tide is to take place;

means connected to said second means and controlled by said second means when real time and high or low tide indications are in coincidence to calculate when the next high or low tide is to occur and thereby generate tide timing signals in correspondence with said timing signals being supplied by said means for generating timing signals;

means for receiving said tide timing signals and said timing signals and transmitting said tide timing signals to said means for generating tide time signals so that upon calculation of when the next high or low tide is to occur said means for generating tide time signals will generate such tide time signals to said first and second means.

9. A programmable electronic time and tide timing device according to claim 8 wherein said means to calculate when the next high tide or low tide is to occur supplies additional tide timing signals to said means connected to said second means for generating said tide timing signals at a selected time.

10. A programmable electronic time and tide timing device according to claim 8 wherein indicating means is connected to said means to calculate when the next high tide or low tide is to occur for indicating at the same time when the high or low tide is displayed whether the tide is a high or a low tide.

* * * * *